US006176394B1

(12) United States Patent
Shimko et al.

(10) Patent No.: US 6,176,394 B1
(45) Date of Patent: Jan. 23, 2001

(54) RESEALABLE CONTAINER WITH TWO PART CLOSURE AND SPOUT

(75) Inventors: Thomas M. Shimko, Tacoma; Lee A. Getzewich, Auburn, both of WA (US)

(73) Assignee: Cascade Designs, Inc., Seattle, WA (US)

( * ) Notice: Under 35 U.S.C. 154(b), the term of this patent shall be extended for 0 days.

(21) Appl. No.: 09/123,938

(22) Filed: Jul. 27, 1998

(51) Int. Cl.[7] ..... B65D 35/00

(52) U.S. Cl. ..... 222/92; 222/185.1; 383/9; 383/41; 383/63; 383/66; 383/67; 383/107; 383/906

(58) Field of Search ..... 222/92, 105, 185.1; 383/9, 41, 63, 66, 67, 107, 906

(56) References Cited

U.S. PATENT DOCUMENTS

| | | | | |
|---|---|---|---|---|
| 4,578,813 | | 3/1986 | Ausnit | 383/65 |
| 4,660,259 | | 4/1987 | Ausnit | 24/587 |
| 4,673,383 | | 6/1987 | Bentsen | 493/381 |
| 4,792,240 | | 12/1988 | Ausnit | 383/63 |
| 4,846,585 | | 7/1989 | Boeckmann et al. | 383/5 |
| 4,878,763 | | 11/1989 | Ausnit | 383/65 |
| 5,050,755 | * | 9/1991 | Marquardt | 222/105 |
| 5,067,636 | * | 11/1991 | Pfeiffer et al. | 222/105 |
| 5,351,369 | | 10/1994 | Swain | 24/304 |
| 5,480,230 | * | 1/1996 | May | 383/9 |
| 5,520,463 | * | 5/1996 | Tilman | 383/63 |
| 5,741,076 | * | 4/1998 | Cammack | 383/9 |
| 5,971,613 | * | 10/1999 | Bell | 383/63 |

* cited by examiner

*Primary Examiner*—Joseph A. Kaufman
(74) *Attorney, Agent, or Firm*—Graybeal Jackson Haley LLP

(57) ABSTRACT

A container according to a first embodiment includes a first panel bonded to all but a segment of an opposing second panel wherein the first and the second panels define an interior chamber and wherein the unbonded segments of the first panel and the second panel define a first opening having a maximum area. Present in the first opening is a two-part linear fluid impervious closure constructed of flexible material. The first part is bonded to the first panel segment of the first opening and the second part is bonded to the second panel segment of the first opening. A spout is bonded to at least the first panel to provide fluid communication between the interior chamber and the environment, and to define an orifice having an area less than the maximum area of the first opening. In a preferred embodiment, interlocking fastener strips are used as the closure. An alternative embodiment has both panels wholly bonded together at their common periphery and a slit in the first panel defines the first opening into which the closure is located and bonded. Methods for making the containers include the steps of locating the closure in the opening and using heat and pressure to effectuate the bonds. Additional heat and pressure is applied to the longitudinal ends of the closure to cause the same to become fused and to cause extrusion of closure material into any gaps that may be present between the closure and the perimeter bonds of the panels.

25 Claims, 6 Drawing Sheets

RESEALABLE CONTAINER WITH TWO PART CLOSURE AND SPOUT

TECHNICAL FIELD

The present invention relates to a collapsible fluid container having a large area resealable opening, preferably elongate and flexible, and a relatively smaller resealable spout.

BACKGROUND OF THE INVENTION

The field of collapsible containers is replete with examples of various volume containers and spout configurations. Generally speaking, these containers are intended to hold fluids of various types. A typical example of a prior art container is one wherein two flexible panels are joined at their common periphery and a spout is located in the face of one panel. Alternatively, the spout may be located between the two panels at their common periphery.

While collapsible containers of the prior art advantageously provide volume efficient containment of various fluids, they commonly suffer from numerous disadvantages. These disadvantages include the inability to manually dry the inside of the container, the inability to manually clean the inside of the container, the inability to quickly fill the container, and most noticeably, the inability to insert large objects into the container. While rigid containers having large orifices overcome many of these disadvantages, such containers do not collapse upon the displacement of fluid or for storage purposes. Moreover, if a large spout were to be incorporated with collapsible containers of the prior art, the desirable attributes inherent with collapsible containers (e.g., foldability) would be compromised.

It is therefore desirable to include the benefits of large orifice openings in a collapsible container without compromising the inherent advantages of a collapsible container. The present invention is intended to achieve the object of providing for a large orifice opening while still retaining the desirable features of a collapsible container.

SUMMARY OF THE INVENTION

The present invention is directed to collapsible containers for retaining and dispensing fluids and methods for making the same. A container according to a first embodiment comprises a first panel bonded to all but a segment of an opposing second panel wherein the first and the second panels define an interior chamber and wherein the unbonded segments of the first panel and the second panel define a first opening having a maximum area; a first part of a two-part fluid impervious closure bonded to the first panel segment of the first opening and a second part of the two-part fluid impervious closure bonded to the second panel segment of the first opening; and a spout bonded to at least the first panel to provide fluid communication between the interior chamber and the environment, and to define an orifice having an area less than the maximum area of the first opening. Preferably, the panels are flexible and the two-part closure is elongate and flexible so that compactability is retained. In a preferred embodiment, interlocking fastener strips are used.

The container according to a second embodiment has the first panel entirely defining the first opening: the two-part fluid impervious closure is bonded to first and second edge portions defining a gap in the first panel; the first and second panels are substantially bonded to one another at a common periphery. In either embodiment, the spout can be located at the face of the first panel or at the perimeter portion and between both panels. A feature of either embodiment includes the integration of grommets located in the upper flange portion of the container to facilitate mounting of the container.

By integrating a large area, resealable opening in a collapsible container, the deficiencies of the prior art collapsible containers are avoided. The user of a container according to the present invention can quickly fill the container with fluids or large objects that would not otherwise transverse the spout opening. Moreover, the user has the ability to manually clean and dry the inside of the flexible container. In addition, the mixing of particles or powders is greatly enhanced. Because the preferred container according to the present invention utilizes a flexible and substantially linear two-part closure, the compactability of the container, as previously noted, is not jeopardized.

Depending upon the extent of manufacturing to be undertaken, several methods for manufacturing the collapsible container of the present invention exist. In a first method, the following steps are undertaken to construct the first embodiment of the invention from components: locating a spout between first and second similarly sized and opposed flexible panels, wherein each panel has a peripheral edge portion; bonding all but a segment of the first panel peripheral edge portion to all but a corresponding segment of the second panel peripheral edge portion whereby the spout creates a fluid pathway between the volume defined by the first and second panels and the environment; locating a two-part fluid impervious closure between the unbonded segment of the first panel peripheral edge portion and the unbonded segment of the second panel peripheral edge portion; and bonding the segment of the first panel peripheral edge portion to one part of the two-part closure, and bonding the segment of the second panel peripheral edge portion to the other part of the two part closure.

Alternatively, partially completed collapsible containers can be obtained from another source, and thereafter modified according to the following steps: locating a two-part fluid impervious closure between the unbonded segment of the first panel peripheral edge portion and the unbonded segment of the second panel peripheral edge portion; and bonding these segment of the first panel peripheral edge portion to the first part of the two-part closure, and bonding the segment of the second panel peripheral edge portion to the other part of the two-part closure.

In the preceding two method embodiments, the two-part closure was located at the peripheral edge portions of the two panels. In order to permit convenient insertion of the two-part closure between the two panels, it is necessary to have a certain degree of clearance between closure and the adjacent peripheral bonds between the container's flexible panels. In order to make the container fluid tight, it is necessary to eliminate this clearance after insertion of the closure. In a preferred embodiment, sufficient compression and heat is applied to the opposing panels at their interface with the two-part closure during the panel-to-closure bonding step so that lateral closure material is extruded into the clearance area. If alternative methods for creating the desired bond between the two-part closure and the opposing panels are used, those persons skilled in the art will appreciate the use of packing or filling materials to eliminate the clearance area.

DETAILED DESCRIPTION OF THE INVENTION

Figure 1:
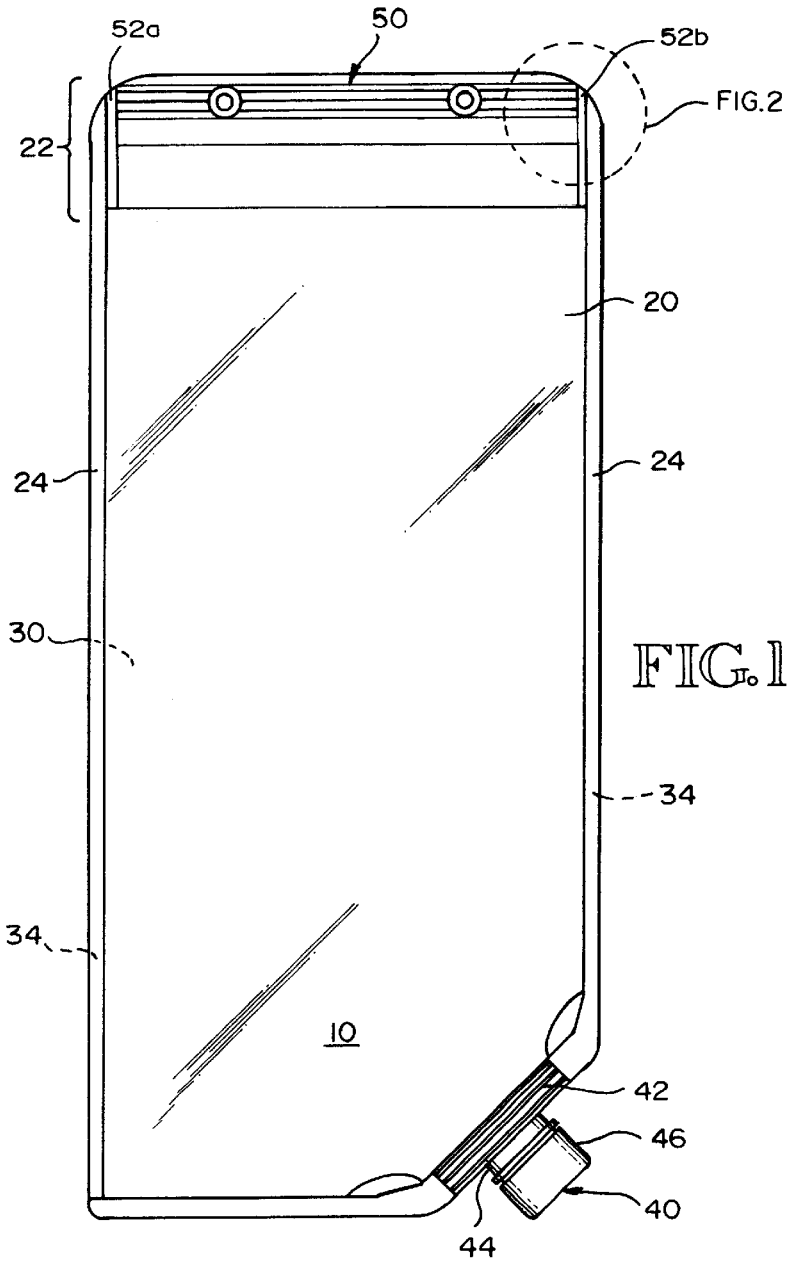
FIG. 1 is a front elevation view of a first embodiment of the invention.

Reference is now made to the several figures wherein like parts have like numerals, and more particularly to FIG. 1 wherein a first embodiment of the invention is shown in elevation. Container 10 has four principal components, namely panel 20, panel 30 (obverse), spout 40, and closure 50. Panels 20 and 30 are preferably constructed from a three-part film laminate. The inner layer is preferably a polyethylene film having a melting point of between 220° F. to 240° F. Bonded to the polyethylene film is a layer of nylon having a melting point of around 400° F. Bonded to the nylon layer is a layer of polyester also having a melting point of about 400° F. The polyethylene layer provides a suitable, food grade, interior surface for container 10, as well as provides favorable melting properties that will be exploited when bonding closure 50 thereto. The nylon layer provides suitable strength, while the polyester layer enhances puncture resistance of container 10. As will be described in detail below, the fact that the polyethylene internal layer has a melting point significantly lower than the nylon or polyester layers, works to the advantage of the present invention.

Figure 4:
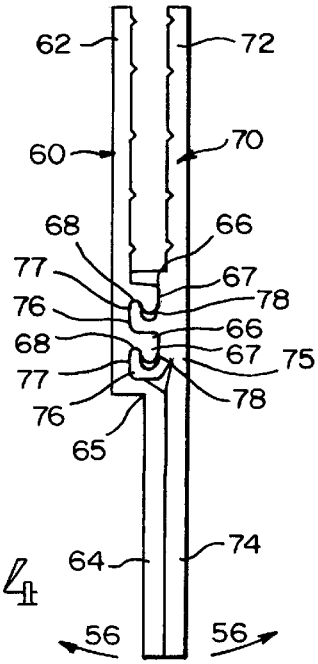
FIG. 4 is a side elevation of the preferred two-part closure detailing the interlocking nature thereof, and the flange relief or hinge portion to prevent lower flange separation.

Turning momentarily to FIG. 4, the various aspects of closure 50 are shown. Notably, closure 50 consists of two complementary members: flexible closure strips 60 and 70. Strip 60 includes upper flange portion 62, lower flange portion 64, ribs 66 having hook portions 67 formed therewith, and channel portions 68. By the same token, strip 70 includes upper flange portion 72, lower flange portion 74, ribs 76 having hook portions 77 formed therewith, and channel portions 78. As shown in the drawings, the cross sectional features of strip 60 are present in strip 70, in complementary fashion, so that a positive and substantially fluid-proof interlock between the two strips is possible.

Closure 50 is preferably constructed from polyethylene having a similar melting point to that of the interior layer of panels 20 and 30. Best results have been obtained by the inventor using a closure sold under the trade name of U-MAXIGRIP (Illinois Tool Works, Inc. a.k.a. ITW, Glenview, Il.). While many interlocking linear fasteners are available, this model is particularly desirable in view of its resistance to pressure breaches as will be discussed below.

A principal objective of the present invention was to incorporate a large area, flexible opening as was described in the sections above. The opening, however, would have to be able to withstand relatively high hydrostatic pressures that might be encountered when container 10 was subject to manipulation, including dropping. When dealing with complimentary closure strips of the type identified herein, opening of a pair of mated strips is accomplished by rolling the upper flanges apart and towards the interlocking portions of the strips. Thus, upper flange portions 62 and 72 are used to separate strips 60 and 70 in a conventional manner. Unfortunately, similar forces are presented with respect to the lower flange portions, i.e., the flange portions bonded to panels 20 and 30, when container 10 is filled with fluid and subject to compression.

Upon close inspection, it can be seen best in FIG. 4 that lower flange portions 64 and 74 have, respectively, hinge portions 65 and 75. By constructing closure 50 to have these hinge portions formed in lower flanges 64 and 74, separation forces indicated by arrows 56 are localized at hinge portions 65 and 75 rather than being transmitted to the interlocking portions of closure 50. By contrast, upper flanges 62 and 72 do not have this corresponding structure, and therefore transmit separation forces to the interlocking portions of strips 60 and 70 to effectuate desired functionality, i.e., separation of strips 60 and 70.

Figure 5:
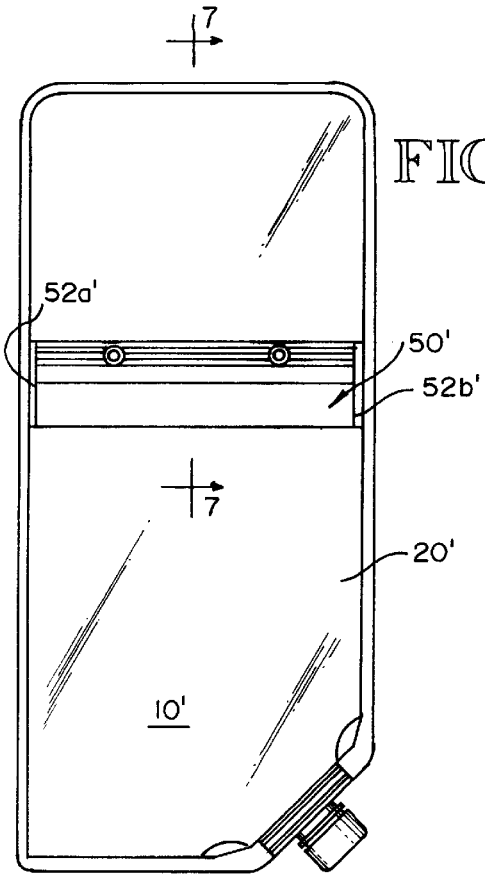
FIG. 5 is a front elevation view of a second embodiment of the invention wherein the closure is disposed between two edge portions of one panel.
Figure 6:
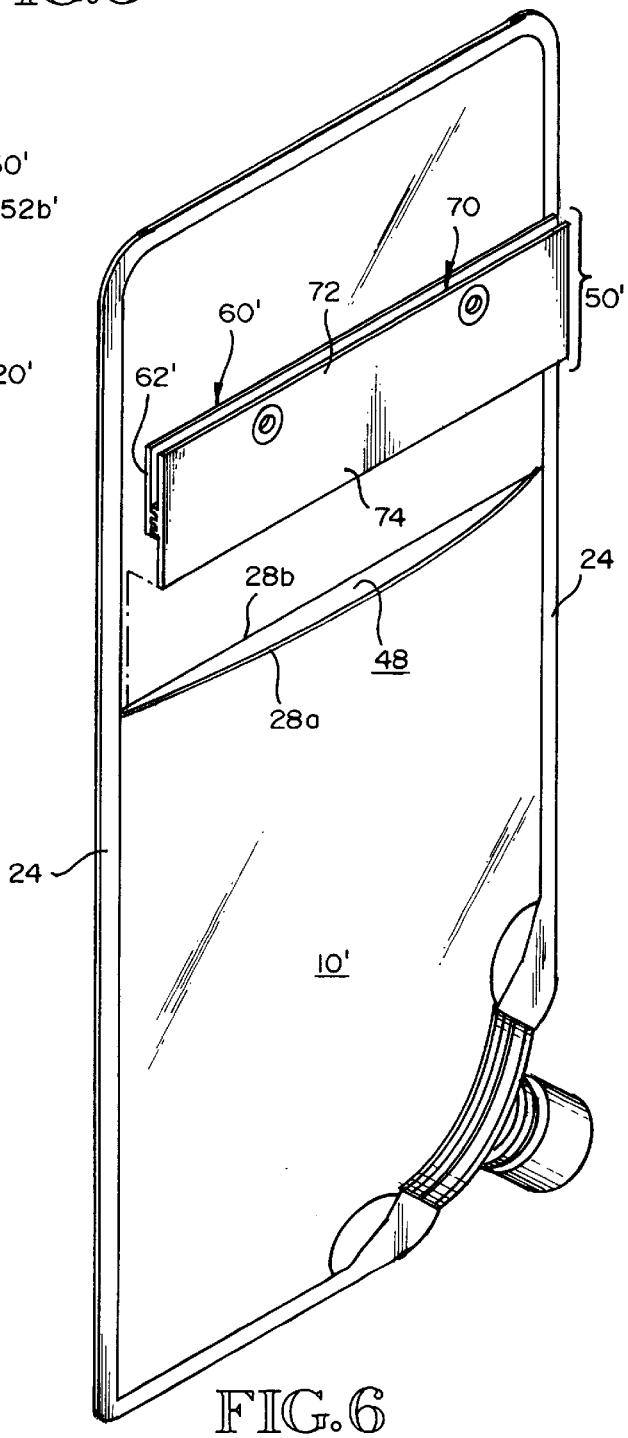
FIG. 6 is a perspective view of the second embodiment of the invention shown with the two-part closure aligned with the flexible container, prior to insertion.
Figure 7:
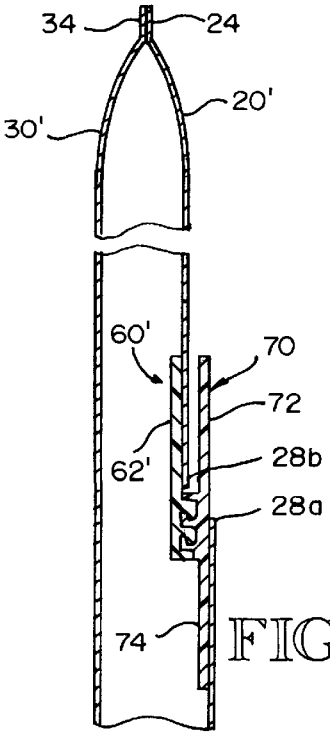
FIG. 7 is a cross sectional view taken substantially along the line 7—7 in FIG. 5 detailing the panel to flange bonds.

An alternative container embodiment to that shown in FIGS. 1–4 is container 10' shown in FIGS. 5–7. As shown therein, closure 50', which may be modified so that lower flange 64 of strip 60 is not present (and is therefore referenced as strip 60'), is disposed in opening or gap 48', which is defined by edge portions 28*a* and 28*b* of panel 20'. Edge portion 28*a* and adjacent panel material is preferably bonded to lower flange 64 and edge portion 28*b* and adjacent panel material is preferably bonded to upper flange 62'. Upper flange 72 is retained to assist in separating strip 60' from strip 70 when closure 50' is sealed. In all other significant respects, the integration of closure 50' into container 10' is similar to that described for the first embodiment.

Figure 8:
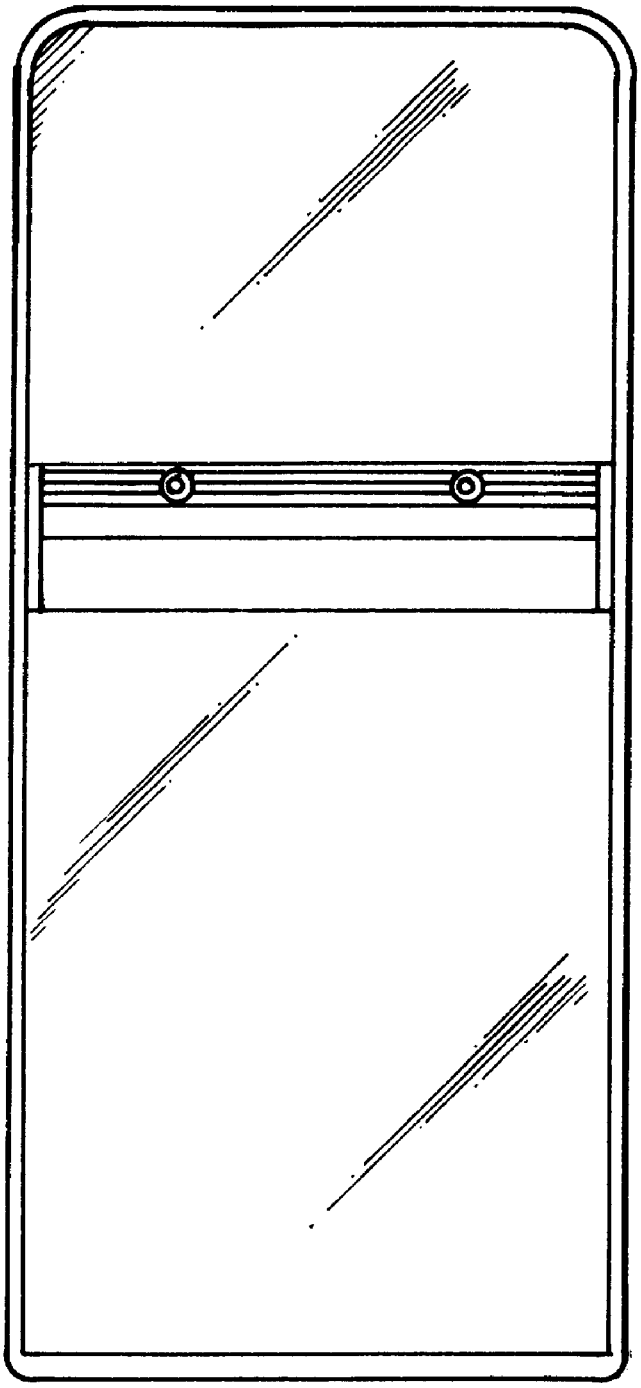
FIG. 8 is a non-spouted variation of the second embodiment.

In FIG. 8, a non-spouted variant of the second embodiment shown in FIGS. 5–7 is presented. With the exception of including spout 40, this variant is identical to the second embodiment.

Figure 3:
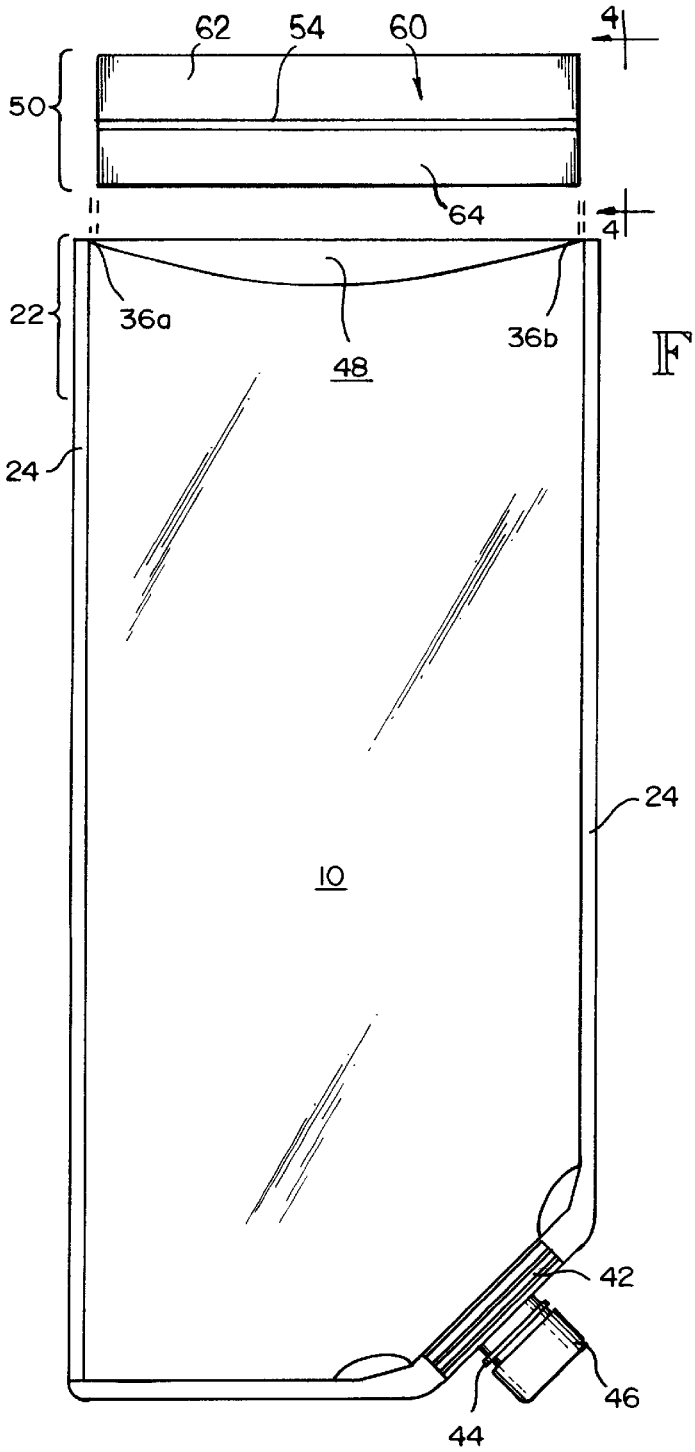
FIG. 3 is a front elevation of the first embodiment of the invention shown with the two-part closure aligned with the flexible container, prior to insertion.

Method of Manufacturing the Invention:

As noted above, panels 20 and 30 are constructed so as to have a polyethylene inner layer that melts at a lower temperature than the panel outer or intermediate layer. Consequently, the inner layer can be melted by application of heat at the outer layer so as to cause melting of the inner layer without destroying the integrity of the intermediate and outer layers. With respect to the methods described herein, it is presumed that container 10 is available substantially as is shown in FIG. 3, in that all required perimeter bonds are formed, as well as integration of spout 40.

What remains to be completed is the integration of closure 50 into container 10. To carry out the preferred bonding process, i.e., a welding process utilizing heat and pressure, two nearly identical and opposed weld dies are used, with one being shown in FIGS. 9 and 10.

Figure 2:
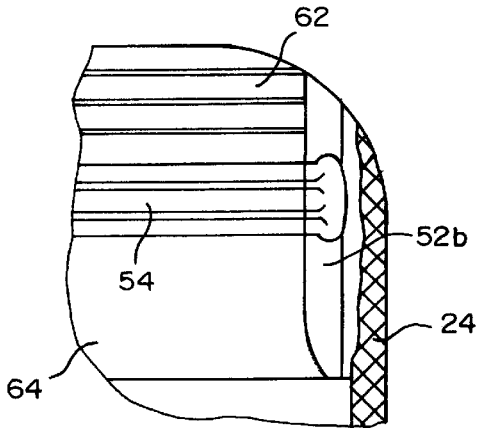
FIG. 2 is a detail of the peripheral weld and extrusion of lateral closure material into the perimeter weld area.

Weld die 80 has various elevations that cause certain zones of container 10 and closure 50 to be compressed, to varying extents, during the closure bonding process. Ideally, upper flanges 62 and 72, and lower flanges 64 and 74 are only slightly compressed so that bonding between these flanges and panels 20 and 30 will take place without noticeable distortion of the flanges or bonding there between. So as to preserve the structural integrity of the interlocking elements of strips 60 and 70, panels 20 and 30 respectively are not bonded thereto. In contrast, edge portions 52*a* and 52*b* should be compressively distorted so as to extrude during the bonding process and occupy any small gap (see gaps 36*a* and 36*b* in FIG. 3) between these edge portions and perimeter bond 24. Refer to FIG. 2 for the resulting extrusion. In addition, the outer portions of interlocking element segment 54 are bonded to prevent complete separation of closure strip 60 from closure strip 70. It is with these objectives in mind that weld die 80 is formed.

Figure 9:
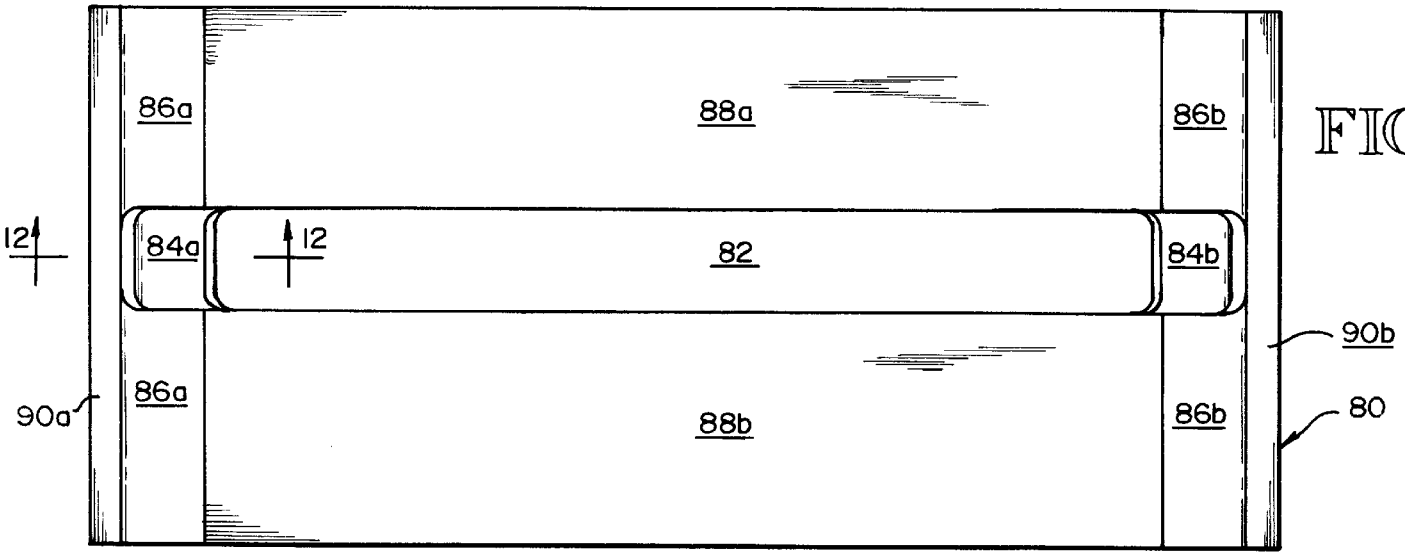
FIG. 9 is a plan view of a weld die.
Figure 10:
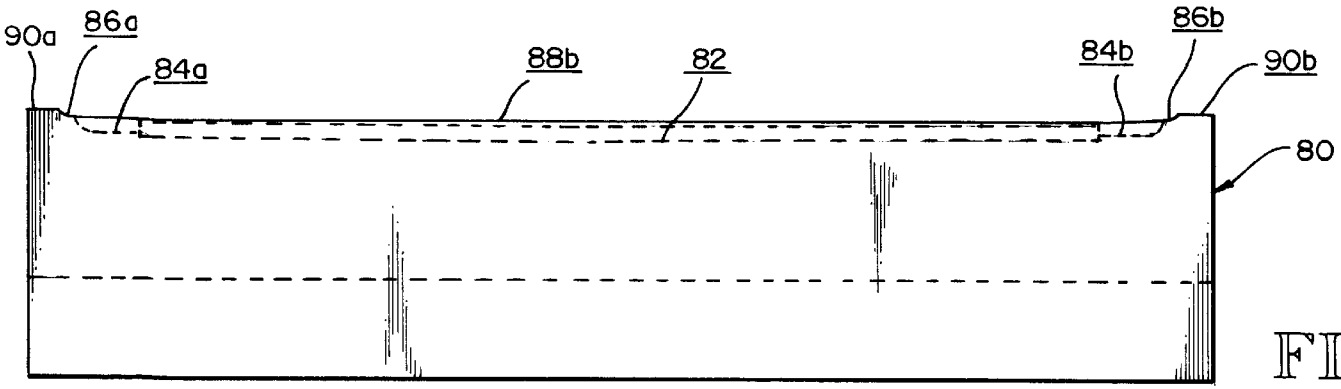
FIG. 10 is a front elevation view (with hidden lines) of the weld die shown in FIG. 9.
Figure 12:
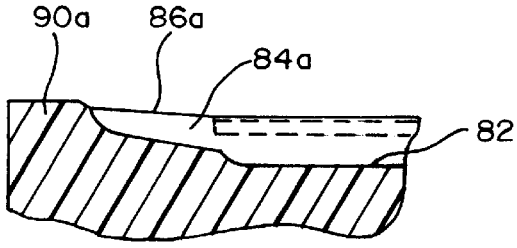
FIG. 12 is a detailed cross section taken substantially along the line 12—12 in FIG. 9.

In particular and is best shown in FIGS. 9, 10, and 12, weld die 80 has, in decreasing order of depth, interlocking element segment recess 82, crimp recesses 84*a* and 84*b*, first edge recesses 86*a* and 86*b*, flange recesses 88*a* and 88*b*, and second edge recesses 90*a* and 90*b*. As noted above, the complementary weld die is nearly, but not exactly identical to die 80 since, as is best shown in FIG. 4, closure 50 is asymmetrical with respect to interlocking element segment. Thus, the depth of recess 82 on the complementary die is not as great as that shown for die 80.

With reference then to FIG. 3, a strip of closure 50 is preferably cut from a roll of closure and sized to be nearly the width of opening 48. Desirably, the length of closure 50 is +1/32" to −1/16" (approximately +0.80 mm to −1.60 mm) the nominal distance between the perimeter bonds. For ease of insertion, the fit should err on the short side. After locating closure 50 in opening 48, the weld dies are heated to approximately 370° F. and are applied to upper portion 22 of container 10. While the pressure and duration of weld die contact varies depending upon the size of the container, its composition, and other manufacturing considerations, typically, global pressures range from 17 to 26 psi and durations range from 6 to 9 seconds when the dies are heated to about 370° F. Nevertheless, the objectives noted above should be remembered when determining pressure and duration values.

To arrest the bonding process, contain the extruded material, and promote desirable solidification of the extruded material, upper portion 22 of container 10 is inserted into a set of quench dies maintained at ambient temperatures. By maintaining upper portion 22 therein for approximately 9 seconds, extruded material at edge portions 52*a* and 52*b* is contained within the corresponding recesses of the quench dies, and the level of undesirable crystallization in the bond is considerably reduced.

Figure 11:
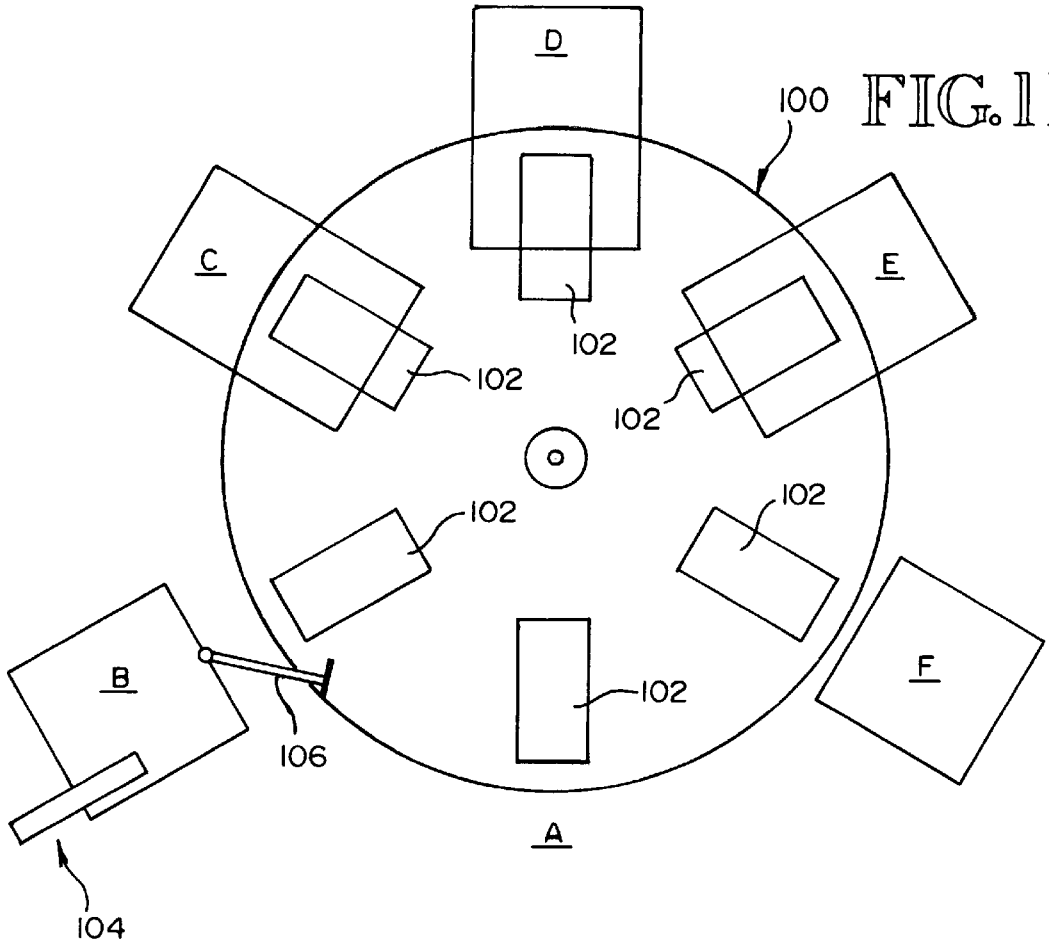
FIG. 11 is a schematic representation of an automated process for creating the invention from partially assembled containers.

Those persons skilled in the art will appreciate the numerous means for carrying out the desired bonding described herein. By way of example only, alternative processes for achieving the bond characteristics include use of a self-quenching weld tool, e.g., induction heating of a die having an integrated fluid cooling circuit, RF welding of the components (care must be taken to select appropriate construction material), and the like. Similarly, the aforementioned manufacturing steps can be automated as is shown, in schematic form, in FIG. 11.

As shown therein, servo controlled, motorized table 100 has several stations located there about. At a first time index, a container resembling that shown in FIG. 3 is placed in alignment fixture 102 at bag loading station A. At the next time index, table 100 is rotated so that alignment fixture 102 is positioned at cutting and inserting station B, at which time a roll of closure material 104 is available for cutting and inserting, via arm 106, into the container located at fixture 102. Vacuum cups (not shown) cause panels 20 and 30 to separate, thereby allowing insertion of an appropriately sized closure segment via arm 106.

After closure 50 is properly aligned within the container, table 100 is again rotated to the next index whereat the container with closure is moved to weld station C. The bonding of closure 50 to the container is accomplished in the manner set forth above, where after table 100 again moves to the next index so that the container may be transferred to quench station D. After completion of this step, table 100 again rotates so as to present the container to punch and trim station E. Here, a rule die and punch combination trims and punches the upper flanges. Next, table 100 rotates so that the finished container, preferably resembling that shown in FIG. 1, is ejected at catch station F for subsequent grommeting and/or packing.

Alternative Embodiments:

As detailed earlier, it is not necessary to locate the spout between the container panels, or locate the sealing elements at the perimeter of the container. Depending upon application and design considerations, it may be preferable to locate the spout on the face of a panel, and/or locate the sealing elements thereat. What is considered to be an improvement over the prior art is the existence of both a relatively small orifice spout with a relatively large area resealable opening, preferably elongate and flexible.

What is claimed:

1. A collapsible container for retaining and dispensing fluids comprising:

a first panel bonded to a segment of an opposing second panel to form a perimeter bond wherein the first and the second panels define an interior chamber and wherein the unbonded segment of the first panel and the unbonded segment of the second panel define a first opening having a maximum area;

a first part of a two-part fluid impervious closure bonded to the first panel segment of the first opening and a second part of the two-part fluid impervious closure bonded to the second panel segment of the first opening; and a spout bonded to at least the first panel to provide fluid communication between the interior chamber and the environment, and to define an orifice having an area less than the maximum area of the first opening wherein the first and the second part of the two-part closure each has a first end and a second end, wherein the first ends of the first and the second part of the two-part closure are bonded together to form a first closure bond, and wherein the second ends of the first and the second part of the two-part closure are bonded together to form a second closure bond.

2. The container of claim 1 the closure is constructed of flexible material.

3. The container of claim 2 wherein the first part of the closure comprises at least one longitudinal rib and the second part of the closure comprises at least one complementary longitudinal channel to receive the rib when in a closed state.

4. The container of claim 2 wherein the first part of the closure comprises an upper flange, a lower flange and at least one longitudinal rib, and the second part of the closure comprises an upper flange, a lower flange and at least one complementary longitudinal channel to receive the rib when in a closed state.

5. The container of claim 4 wherein the lower flange of the first and second part of the closure is bonded to the first and second panels, respectively.

6. The container of claim 4 wherein both the upper and lower flanges of the first and second part of the closure are bonded to the first and second panels, respectively.

7. The container of claim 1 wherein each panel is constructed of a laminate material having an inner layer and the closure is constructed from the same material as the inner layer.

8. The container of claim 1 wherein the first and second panels are bonded to the closure by heat and pressure sufficient to partially melt the first panel to the first part of the closure and the second panel to the second part of the closure.

9. The container of claim 1 wherein the first and second closure bonds include extruded material that contact a portion of the perimeter bond between the first and second panels.

10. A collapsible container for retaining and dispensing fluids comprising:

a first panel comprising an inner layer of a first material bonded to all a segment of an opposing second panel comprising an inner layer of the first material to form a perimeter bond wherein the first and the second panels define an interior chamber, and wherein the unbonded segment of the first panel and the unbonded segment of the second panel define a first opening having a maximum area;

a flexible and generally elongate fluid impervious closure having a first part and a second part wherein at least a lower flange portion of the first part is bonded to the inner layer of the first panel segment of the first opening and at least a lower flange portion of the second part is bonded to the inner layer of the second panel segment of the first opening, and wherein the first part comprises at least one longitudinal rib and the second part comprises at least one complementary longitudinal channel to receive the rib when in a closed state; and a spout bonded to at least the first panel to provide fluid communication between the interior chamber and the environment, and to define an orifice having an area less than the maximum area of the first opening wherein the first and the second part of the closure each has a first end and a second end, wherein the first ends of the first and the second part of the closure are bonded together to form a first closure bond, and wherein the second ends of the first and the second part of the closure are bonded together to form a second closure bond.

11. The container of claim 10 wherein the first and second closure bonds include extruded material that contact a portion of the perimeter bond between the first and second panels.

12. The container of claim 11 wherein the inner layer material of the first and second panels is polyethylene and wherein the closure is constructed of polyethylene.

13. The container of claim 12 wherein the first and second panels are bonded to the closure by heat and pressure sufficient to partially melt the first panel to the first part of the closure and the second panel to the second part of the closure.

14. The container of claim 12 further comprising at least one grommet formed in a portion of the closure.

15. The container of claim 14 wherein the at least one grommet is formed in an upper flange portion of the first and the second part of the closure.

16. The container of claim 10 wherein the perimeter bond comprises the first ends of the first and the second part of the closure, and the second ends of the first and the second part of the closure.

17. A collapsible container for retaining and dispensing fluids comprising:

a first panel bonded to an opposing second panel to form a perimeter bond wherein the first and the second panels define an interior chamber and wherein the first panel has a first edge portion and a second edge portion that define a first opening having a maximum area;

a first part of a two-part fluid impervious closure bonded to the first edge portion of the first panel and a second part of the two-part fluid impervious closure bonded to the second edge portion of the first panel segment; and a spout bonded to at least the first panel to provide fluid communication between the interior chamber and the environment, and to define an orifice having an area less than the maximum area of the first opening wherein the first and the second part of the closure each has a first end and a second end, wherein the first ends of the first and the second part of the closure are bonded together to form a first closure bond, and wherein the second ends of the first and the second part of the closure are bonded together to form a second closure bond.

18. The container of claim 17 the closure is constructed of flexible material.

19. The container of claim 18 wherein the first part of the closure comprises at least one longitudinal rib and the second part of the closure comprises at least one complementary longitudinal channel to receive the rib when in a closed state.

20. The container of claim 18 wherein the first part of the closure comprises an upper flange, a lower flange and at least one longitudinal rib, and the second part of the closure comprises an upper flange and at least one complementary longitudinal channel to receive the rib when in a closed state.

21. The container of claim 20 wherein the lower flange of the first part of the closure is bonded to the first edge of the first panel, and the upper flange of the second part of the closure is bonded to the second edge of the first panel.

22. The container of claim 20 wherein the upper flange of the second part of the closure is bonded to both the first and second panels.

23. The container of claim 17 wherein each panel is constructed of a laminate material having an inner layer and the closure is constructed from the same material as the inner layer.

24. The container of claim 17 wherein the first and second panels are bonded to the closure by heat and pressure sufficient to partially melt the first part of the closure to the first edge of the first panel, and the second part of the closure to the second edge of the first panel.

25. The container of claim 17 wherein the first and second closure bonds include extruded material that contact a portion of the perimeter bond between the first and second panels.

* * * * *